United States Patent [19]

Monpetit

[11] 3,946,704

[45] Mar. 30, 1976

[54] APPARATUS FOR CONTROLLING TRANSIENT OCCURRENCES IN AN ELECTRONIC FUEL INJECTION SYSTEM

[76] Inventor: Louis Monpetit, 16 bis, Chemin de la Butte, 78-L'Etang-la-Ville, France

[22] Filed: June 24, 1974

[21] Appl. No.: 482,137

[30] Foreign Application Priority Data

June 27, 1973 France ..... 73.23450

[52] U.S. Cl. ..... 123/32 EA; 123/119 R

[51] Int. Cl.[2] ..... F02B 3/00

[58] Field of Search ..... 123/32 EA, 119 R

[56] References Cited

UNITED STATES PATENTS

| | | | |
|---|---|---|---|
| 3,620,196 | 11/1971 | Wessel | 123/32 EA |
| 3,645,240 | 2/1972 | Monpetit | 123/32 EA |
| 3,646,918 | 3/1972 | Nagy et al. | 123/32 EA |
| 3,651,343 | 3/1972 | Monpetit | 123/32 EA |
| 3,672,345 | 6/1972 | Monpetit | 123/32 EA |
| 3,780,587 | 12/1973 | Rivere | 123/32 EA |
| 3,823,696 | 7/1974 | Mutschler et al. | 123/32 EA |
| 3,858,561 | 1/1975 | Aono | 123/32 EA |

*Primary Examiner*—Charles J. Myhre
*Assistant Examiner*—Paul Devinsky
*Attorney, Agent, or Firm*—Darby & Darby

[57] ABSTRACT

A circuit for controlling transient occurrences in an electronic fuel injection system in which the occurrence is sensed and used to produce auxiliary injection signals which are combined with the main injection signals from the injection system computer. The time of production and the duration of the auxiliary signals can be controlled in response to operating conditions of the engine.

11 Claims, 3 Drawing Figures

APPARATUS FOR CONTROLLING TRANSIENT OCCURRENCES IN AN ELECTRONIC FUEL INJECTION SYSTEM

The invention relates to a transitory regulating device for an electronic injection system, particularly for one used with an internal combustion engine of a motor vehicle.

In an electronic injection system it is known that it is sometimes necessary, for example during an acceleration or a deceleration, to temporarily modify the duration of an injection signal. It is known, for example, to proceed to do this by cutting off the injection signal or to increase the duration of the injection signal, or to produce a certain number of supplementary injection signals, the frequency of which depends, for example, on the variation in the position of the butterfly valve in the fuel system.

The present invention has a different conception and relates to a transitory regulating circuit for an electronic injection system for an internal combustion engine. In accordance with the invention, a first pickup measures a physical parameter of the engine and a circuit detecting abrupt variations in this parameter to produce an output signal. A first switching circuit responds to this output signal to deliver a controlled duration signal. An electronic gate receiving the controlled duration signal from the switching circuit and input pulses coming from a motor position pickup produces output pulses at the frequency of the input pulses or at some other frequency. A second switching circuit transforms the output pulses into auxiliary signals of determined duration. Said auxiliary signals and normal injection signals processed by a computer are then combined.

According to the invention, the duration of the signals produced by the first switching circuit is controlled either by the duration of the output signal of the detection circuit, or are of a predetermined fixed duration, or are controlled by a duration determined by a measured parameter of the engine.

As another feature of the invention, the frequency of the pulses coming from the motor position pickup can be divided by an intermediate circuit delivering the pulses to the electronic gate and to the computer. Moreover, the duration of the auxiliary signals delivered by the second switching circuit is determined, that is to say, either fixed or set by means of a second pickup sensing an operating parameter of the engine. Finally, the combining circuit for the normal and auxiliary injection signals is a gate of the AND or OR type, according to the mode of action selected, and it is followed by an amplifier for power drive of the injectors.

Thus, according to the invention, an abrupt variation in an operating parameter of the engine is detected. This variation is used with the appearance of electrical signals emitted synchronously with the motor at a frequency which, according to the choice, is equal to, higher than or lower than that of the normal injection signals, to produce auxiliary injection signals for the engine. The said auxiliary signals thus produced are square wave signals of fixed or variable duration. If the duration of the auxiliary signals is variable, they depend on at least one of the characteristic parameters of the motor, or on a parameter imposed externally. The production of said auxiliary signals ceases a certain time after the start of their production, this time also being fixed or variable. In the event that this time of production is variable, it depends on at least one of the characteristic parameters of the working state of the motor, or on an externally imposed parameter. The production of the auxiliary signals can also cease when the number of such signals produced has reached a predetermined value. The production always ceases with the appearance of a variation, in a direction opposite to that which triggered the original production. The said auxiliary signals are combined in such a way that they are added to, or subtracted from, the normal injection signals triggered by the principal motor regulating signal.

Other characteristics of the invention will be apparent in the description which follows, made in reference to the attached drawing, in which.

Figure 1:
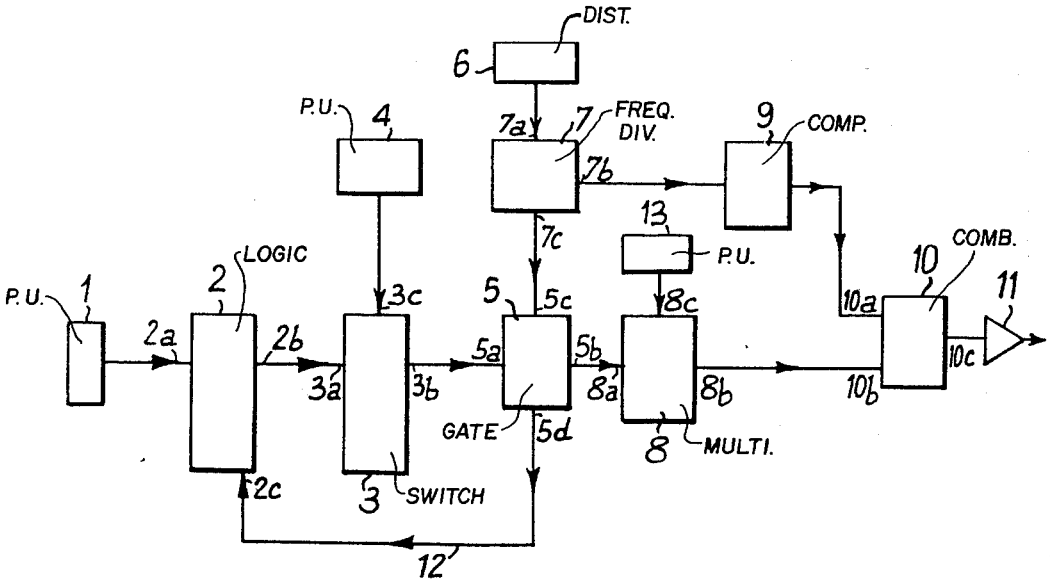
FIG. 1 is a simplified schematic diagram of the regulating circuit according to the invention.

Referring to FIG. 1, an operating parameter A of the engine is translated into an electric quantity, for example a difference in potential, by a pickup 1. The engine parameter measured can be, for example, a change in engine manifold air pressure, increase in acceleration, change in butterfly position, etc. The output signal from the pickup 1 is applied to input 2*a* of a circuit 2, whose output 2*b* changes its logic state, from "normal" to "excited," when the signal at its input 2*a* changes abruptly. The "normal" state originally existing at 2b is returned, necessarily, if the signal emitted by pickup 1 shows a variation in the direction opposite to that which initiated the procedure. Moreover, after passage of 2*b* from the normal to the excited state, the normal state is returned either naturally, a certain time after the end of the variation of the signal applied at 2*a*, or after a certain number of signals have been applied at an input 2*c* of circuit 2.

The change of 2*b* from the normal state to the excited state causes, in turn, the switching of a first switching circuit 3 whose input 3*a* receives the signal emitted by 2*b*. The output 3*b* of circuit 3 changes from a so-called "normal" state to a so-called "excited" state when input 3*a* itself changes from the normal state to the excited state. Circuit 3*b* returns from the excited state to the normal state, necessarily when circuit 2 returns from the excited state to the normal state, or after a fixed time, even if 2*b* remains in the excited state, or after a variable time even if 2*b* remains in an excited state. The return to the normal state of circuit 3 after a variable time depends on an electrical signal sent to the input 3*c* of switching circuit 3 by a pickup 4 of the control quantity of the time of the excited state of switching circuit 3.

Output 3*b* is connected to input 5*a* of a gate circuit 5. This circuit receives at a second input 5*c*, pulses produced by a circuit 7 receiving, at its input 7*a*, signals produced by a device 6, of a known type, which detects the passage of the motor through a certain number of positions marked out in advance. Output 7*c* of circuit 7 produces signals at a frequency equal to that of the signals applied to input 7*a* from the engine or just a certain number of these signals. Output 7*b* passes triggering signals selected from among those received at 7*a* to the main computer 9 which controls the fuel injection for the engine. The computer can be of the type, for example, as disclosed in U.S. Pat. 3,710,763, granted Jan. 16, 1973 and assigned to the assignee of this application.

When the excited state exists at 5*a*, and there simultaneously is a signal at 5*c*, a signal will appear at 5*b* which, at input 8*a* trips a second switching circuit 8. Circuit 8 then produces at its output 8*b*, an auxiliary signal of fixed, or perhaps variable, duration, the latter by means of a signal produced by a pickup 13 corresponding to an operating parameter of the engine. The signal produced at output 8*b* is addressed to input 10*b* of a combining circuit 10. Circuit 10 receives, at its other input 10*a*, the normal injection signal from computer 9 and it combines the two signals and from them forms either the sum or the difference. The combined signal appears at 10*c* which triggers, via an amplifier 11, the injection system.

If it is desired to limit the number of auxiliary signals, the signals emitted at 5*b*, for example, are likewise applied to output 5*d* of gate 5 and input 2*c* of circuit 2 to determine the resetting into the normal state of switching circuit 2 after a certain number of signals from circuit 7.

There are a very large number of electronic circuits capable of fulfilling the roles assigned to circuits 2 to 11. Therefore, only one example for each circuit is given, the said example being replaced in the overall scheme of the device without imparting a limiting nature to this description.

Figure 2:
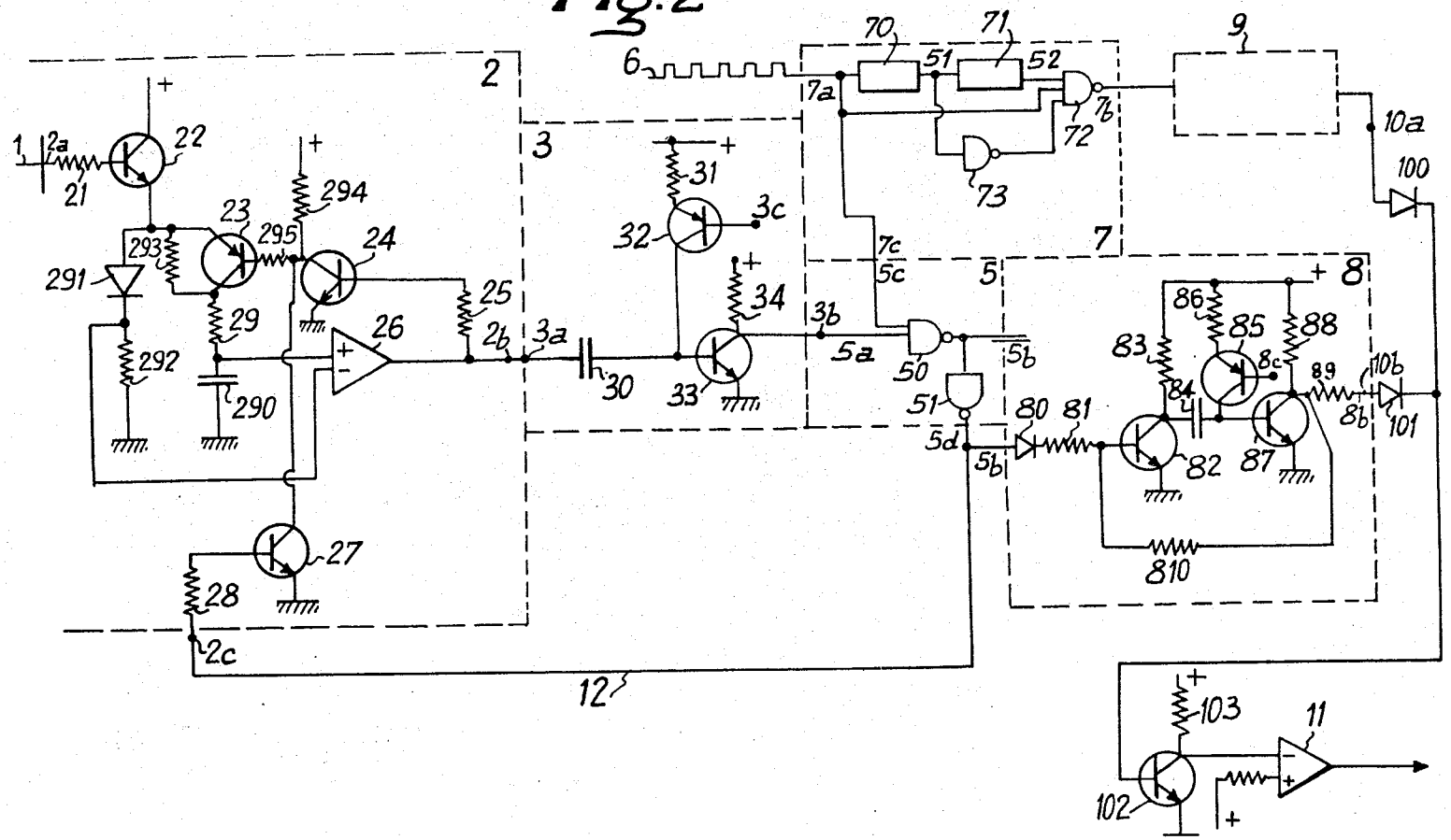
FIG. 2 is a circuit diagram of a typical embodiment of the regulating circuit according to the invention.

In FIG. 2, the input signal A, which is assumed to be a DC voltage produced by pickup 1, is applied by a resistor 21 to the base of a transistor 22. This is connected as an emitter follower so as not to disturb the signal produced by the pickup 1, which is also used for other purposes. When the potential emitted by pickup 1 rises abruptly, the emitter potential of transistor 22 rises likewise. It should be understood that the direction of variation chosen here is positive by way of example but has no limiting character with respect to the invention. The voltage applied to the inverted (−) input of a comparator 26 also rises. As a matter of fact, the voltage of the inverted input of comparator 26 is that present across the terminals of a resistor 292, that is to say, the emitter voltage of transistor 22, reduced by the drop generated by a diode 291.

The output of comparator 26 is normally high. A transistor 24 is normally conductive, and hence it will produce, through a resistor 295, a low potential at the base of a transistor 23 causing this transistor to be conductive. Therefore, since transistor 23 is saturated in the normal state, a capacitor 290 connected to the collector of transistor 23 is charged through transistor 23 (and secondarily a resistor 293) and resistor 29. Resistor 29 is actually at the emitter voltage of transistor 22, hence higher (by the junction voltage of diode 291) than the inverted input of comparator 26, whose output therefore is high since the voltage at the normal (+) input is higher than that of the inverted input.

If the variation measured is produced rather abruptly, so that capacitor 290 cannot be charged quickly, the potential at the normal (+) input of comparator 26 becomes less than that at the inverted input. This causes switching (low output) of comparator 26 and the consequent blocking of transistors 24 and 23. The low output of comparator 26 is the excited state for circuit 2.

This excited state is maintained unless the polarity of the signal produced by pickup 1 reverses and the potential of the inverted input becomes less than that of the normal input of comparator 26. The resistor 293 which is connected in parallel with transistor 23, limits the duration of the excited state.

If positive pulses are applied to input 2c and at the base of a transistor 27, through resistor 28, each pulse will make transistor 23 conductive. This leaves the charge of capacitor 290 until the time when sufficient pulses applied at input 2c will have permitted the charging of capacitor 290 up to a level sufficient to produce switching of the comparator 26 to its normal state since transistor 23 becomes conductive again. This circuit, given by way of illustration of a type of circuit 2, satisfies the requirements given in the general description. The output signal at 2*b* is essentially a square wave signal since it is produced by comparator 26 being turned on and off.

Switching circuit 3 is formed essentially by a monostable circuit and a large variety of such circuits are available. By way of example a simple circuit is illustrated. This circuit, for example, is modulated by an input 3*c* which receives a voltage generated by a pickup 4 (not shown), which measures an operating parameter of the engine. The voltage at 3*c* is lower in amplitude than the supply voltage (+) of the circuit and makes a transistor 32 conductive. Transistor 32 is connected as a current generator in series with a resistor 31. The current produced normally makes a transistor 33 conductive, so that the collector (output 3b) of transistor 33 is normally low.

When output 2*b* of circuit 2 switches to low as explained above, that is to say, in the excited state, a capacitor 30 supplies a negative giving pulse to the base of transistor 33. Transistor 33 is then blocked, so that its output 3*b* switches to the excited level (high) by means of resistor 34 which applies voltage to its collector. Capacitor 30 receives the current furnished by transistor 32, thus depending on the voltage applied at 3*c*. At the end of a time depending on this voltage, when the base potential of transistor 33 reaches the level of conduction, the output 3*c* switches to the normal state. If, in the course of operation, output 2*b* of circuit 2 switches high (normal) the signal transmitted by capacitor 30 immediately makes transistor 33 conductive, and output 3*b* low (normal). As a result, this circuit responds well to the requirements described in the general explanation.

If the duration of the action of circuit 2 is not to be limited by the switching circuit 3, but to be governed directly by the duration of action of the auxiliary signals, the circuit 3 of FIG. 2 would be replaced by a simple inverter. The output of circuit 3 at 3*b* is also essentially a square wave due to the switching action of the unit components.

Circuit 5 comprises, in the illustrative example, a NOT AND gate 50 and a NOR gate 51 whose operation is conventional. Gate 50, with two inputs, reeives, at the first, the output 3*b* of switching circuit 3. The other input receives triggering pulses selected, as is explained below, by circuit 7. These pulses are assumed to be positive going in nature. It follows that the triggering pulses from 7 arriving at input 5*c* are not transmitted through to 5*b* (as negative pulses) or to 5*d* or 5*b* (as positive pulses) unless switching circuit 3 is in an excited (high) state.

Figure 3:
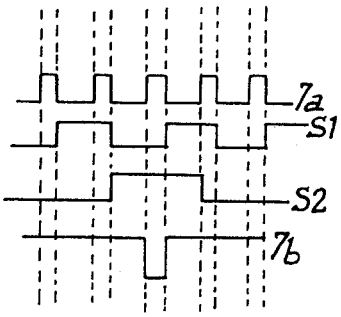
FIG. 3 is a table of electrical signals.

At 6 in FIG. 2 there is represented the pulses coming from a position pickup, of which there are a very wide variety. These pulses are synchronous with the motor rotation, and of a frequency which is equal to, or a multiple of, the frequency of revolution of the camshaft of the said motor. There is shown by way of illustration, which is not-limiting, however the case where only one out of four of these pulses is to trigger the normal process of injection. Circuits 70 and 71 are, for example, flip-flops of the JK type connected in series, whose operation is represented in FIG. 3. With the pulses coming from pickup 6 there is produced at $S_1$, the output of flip-flop 70, the signals represented in second line of FIG. 3. The third line of FIG. 3 shows the signals at the output $S_2$ of the second flip flop 71.

With the aid of inverter 73 and a NOT AND gate 72, the input at *7a* and the outputs $S_1$ and $S_2$ are processed to obtain at *7b*, a signal equal to that applied at *7a*, but divided in frequency by four. This is the case, for example in a fourcylinder four stroke motor, in which pickup 6 would comprise the system of ignition and injection operated once per motor cycle. The lower frequency signals at *7b* are applied to the computer 9 which produces the normal injection signals. At *7c* the signal from *7a* is directly received, in the example described, with a frequency higher by a factor of four than the frequency of the "normal" injection signals at *7b*. These higher frequency signals are applied to NOT AND gate 50.

According to the general circuit of FIG. 1, signals appear at *5b* and *5d* with a frequency higher by a factor of four than that of the normal injection signals present at *7b* only when switching circuit 3 is in the excited state. These signals can be applied on the one hand through *2c* to circuit 2 in order to obtain, as mentioned in regard to this circuit, a limitation on the number of auxiliary pulses, of the excited state of the circuit 2, and hence of the whole process. Furthermore, the same signals from *5b*, applied to a second multivibrator 8, will determine the durations off the auxiliary injection signals. Circuit 8 here represented, is completely conventional.

Normally, a drive voltage applied at an input *8c* from an external source to the base of a transistor 85 makes the latter conductive. The current furnished by this transistor is determined by the valve of the voltage applied at 8c, and by the value of resistance 86. This current, which is furnished to the base of a transistor 87, makes the latter conductive. When transistor 89 is conductive its collector is low, and consequently, through resistor 89, output *8b* is low, and through resistor 810 a transistor 82 is blocked. The collector of transistor 82 is therefore high and capacitor 84 connected between the collectors of transistors 82 and 85 is charged with positive polarity to the left and low to the right. A positive pulse delivered at *5b* and applied to the base of transistor 82 through a diode 80 and a resistor 81, makes transistor 82 conductive and its collector potential low. The base potential of transistor 87 is therefore very low, and transistor 87 is blocked. Its collector becomes high and hence, through resistor 89, the output *8b* is high, and through resistance 810 the base of transistor 82 is high. This state will continue until the current delivered by transistor 85, which is modulated if necessary by a voltage applied at *8c* by some pickup 13 sensing an engine operating parameter (not shown in FIG. 2) and characteristic of the motor or an outside action, has discharged capacitor 84. This causes a regenerative action to make circuit 8 switch back into the original state.

At *8b*, signals with a width determined by switching circuit 8 as determined by the voltage at *8c*, appear at a frequency synchronous with the motor as determined by circuits 7 and 5. These signals appear at *8b* for a period of time limited by switching circuit 3 or by the excited state of circuit 2 which is itself optionally dependent on the number of signals which have been delivered by *5d*. These positive-going output signals at *8b* are addressed through diode 101 to an inverter transistor 102, in parallel with the normal injection signals (assumed to be positive) delivered by normal computer 9 through a diode 100. Each time that one or the other of these signals appears, transistor 102, which functions as an inclusive OR circuit, becomes conductive so that its collector, which is normally high through resistor 103, goes low during the duration of the signal applied. The collector of transistor 103, which is connected to the inverting (−) input of an amplifier 11, causes the output of this amplifier to go high.

By combinations of normal signals of pulses and auxiliary signals, a wide variety of operations can be carried out, the description of which would be unnecessarily long and they form part of conventional technique.

For example, if, instead of the inclusive OR, an exclusive OR can be used at 102. Thus, the addition of the auxiliary signals can be obtained when they are outside a normal signal (addition of signals) and the subtraction (of duration) in case of coincidence.

What is claimed is:

1. Apparatus for producing auxiliary control signals in an electronic fuel injection system for an engine of a motor vehicle in response to transitory changes in an operating condition of said engine comprising:

means for sensing said operating condition and producing a first signal corresponding thereto, means responsive to abrupt changes in said first signal for producing a controlled duration output signal, means for producing a series of pulses corresponding to the speed of rotation of the engine, gate means receiving at one input thereof said controlled duration output signal and at another input thereof said series of pulses, said gate means delivering output pulses at the frequency of the series of pulses applied to its other input upon the application of said controlled duration output signal to its one input, means for receiving said output from said gate means for producing said auxiliary control signals with a controlled duration, computer means for producing normal fuel injection control signals, and means for combining said auxiliary and said normal injection control signals to produce a composite control signal.

2. Apparatus as in claim 1 wherein said series of pulses is applied to said computer means which includes means responsive to said series of pulses for determining the time of production of said normal control signals.

3. Apparatus as in claim 1 wherein said means for producing said controlled duration output signal produces said signal for the time of the abrupt change in said first signal.

4. Apparatus as in claim 1 further comprising means for sensing an operating parameter of the engine and producing a second signal representative thereof, said means for producing said controlled duration output signal including means responsive to said second signal to determine the duration of production of said output signal.

5. Apparatus as in claim 1 wherein said means for producing said controlled duration output signal includes means for fixing the duration of said output signal.

6. Apparatus as in claim 3 further comprising means receiving said series of pulses and for producing a second series of pulses at a reduced frequency, said series of pulses being supplied to said gate means and the second series of pulses of the reduced frequency being supplied to said computer means.

7. Apparatus as in claim 1 wherein said last-named means for producing said auxiliary control signals includes means for producing said signals with a fixed duration.

8. Apparatus as in claim 1 further comprising means for sensing an operating condition of said engine and producing a third signal, said means for producing said auxiliary control signals including means responsive to said third signal for determining the duration of said auxiliary control signals.

9. Apparatus as in claim 1 further comprising means for supplying said output pulses from said gate means back to said means for producing said controlled duration output signal, said last-named means including means responsive to receipt of said output pulses for determining the duration of said controlled duration output signal.

10. Apparatus as in claim 1 wherein said combining means includes means for adding said normal and said auxiliary control signals.

11. Apparatus as in claim 1 wherein said combining means includes means for subtracting said normal and said auxiliary control signals.

* * * * *